United States Patent [19]

Hashimoto et al.

[11] Patent Number: 4,934,267

[45] Date of Patent: Jun. 19, 1990

[54] PRINTING PLATE FOR FLEXOGRAPHIC PRINTING AND METHOD OF MAKING

[75] Inventors: Takeji Hashimoto; Minoru Murayama, both of Kyoto, Japan

[73] Assignee: Dainippon Screen Mfg. Co., Ltd., Japan

[21] Appl. No.: 163,293

[22] Filed: Mar. 2, 1988

[30] Foreign Application Priority Data

Mar. 3, 1987 [JP] Japan ..... 62-49854

[51] Int. Cl.[5] ..... B41N 1/00; B41C 1/00

[52] U.S. Cl. ..... 101/395; 101/401.1

[58] Field of Search ..... 101/395, 379, 376, 401.1

[56] References Cited

U.S. PATENT DOCUMENTS

| | | | |
|---|---|---|---|
| 1,589,665 | 6/1926 | Schmutz | 101/395 |
| 2,043,154 | 6/1936 | Damm | 101/401.1 |
| 2,100,358 | 11/1937 | Royse et al. | 101/401.1 |
| 2,271,124 | 1/1942 | Juve et al. | 101/401.1 X |
| 2,358,189 | 9/1944 | Sprigg et al. | 101/379 X |
| 2,774,302 | 12/1956 | Stromme | 101/395 X |
| 3,085,507 | 4/1963 | Kunetka | 101/395 X |
| 3,130,670 | 4/1964 | Macy | 101/395 X |
| 3,186,894 | 6/1965 | Liles et al. | 101/379 X |
| 4,574,697 | 3/1986 | Feeley | 101/395 X |

FOREIGN PATENT DOCUMENTS 2064032 3/1969 France .

*Primary Examiner*—Clifford D. Crowder

*Attorney, Agent, or Firm*—Ostrolenk, Faber, Gerb & Soffen

[57] ABSTRACT

The flexographic printing plate comprises a support base (14) which is to be the base of the printing plate, a plate surface supporter (12) for supporting the plate surface detachably bonded on the support base (14) in the region smaller than the support base (14), and a plate body (10) detachably bonded on the plate surface supporter (12) in the region smaller than the plate surface supporter (12), the surface of the plate body constituting the printing surface, whereby the printing pressure is received by the plate body (10) and the plate surface supporter (12).

36 Claims, 3 Drawing Sheets

PRINTING PLATE FOR FLEXOGRAPHIC PRINTING AND METHOD OF MAKING

BACKGROUND OF THE INVENTION

1. Field of the Invention

The present invention relates to a printing plate used in flexographic printing and, more particularly, it relates to a flexographic printing plate which is easily manufactured and capable of high quality printing.

2. Description of the Prior Art

A flexographic printing plate has been conventionally manufactured in the following manner. In the first method, the printing plate is formed by manually engraving a plate material of natural rubber or synthetic rubber. In the second method, it is manufactured by molding. That is, natural rubber, synthetic rubber or synthetic resin is poured into a mold made of a thermosetting resin. In the third method, the printing plate is formed by exposing a photosensitive resin with the desired regions masked. In the fourth method, which has become popular recently, the rubber material is engraved by an NC (numerical control) apparatus using laser light.

FIG. 1 is a plan view of a conventional flexographic printing plate and FIGS. 2A and 2B are cross-sectional views taken along the line II—II of FIG. 1. Referring to FIGS. 1, 2A and 2B, the conventional rubber plate comprises a convex portion 1 with a flat surface whose upper surface is to be the printing surface 5 and a support rubber portion 3 for supporting the convex portion 1. The support rubber portion 3 includes a textile layer for preventing the support rubber portion 3 from being stretched. The convex portion 1 may have a vertical edge at the top end surface thereof (FIG. 2A) or the convex portion may have a taper formed from the top end surface thereof (FIG. 2B).

The method of manually engraving the rubber plate will be described below.

When the rubber plate is directly engraved by manual operation, a pattern or character is transferred onto the surface of the rubber plate material with the scale thereof reduced in one direction. When the plate is mounted on the peripheral surface of a press cylinder, the printing plate extends in the peripheral direction. The above described reduction of the pattern, character and the like compensates for the resulting extension of the plate. Thereafter, a line is cut along the contour of the transferred pattern or the like by a pointed knife. The unnecessary portion on one side of the cut line is removed by an engraving knife. When the contour is cut by a pointed knife, there arises some problems if the surface of the plate material is vertically cut from above. Namely, if the width of the image area (i.e. relief) of the obtained printing plate is narrow and the height thereof is about 5 mm (the normal thickness of the plate material is 7 mm), then accurate printing cannot be obtained since the strength of the image area is not sufficient. More specifically, the image area cannot stand the pressure applied at the time of printing, and the image area deforms in the transverse direction. Therefore, the side surfaces 2 and 2' of the convex rubber 1 and 1' constituting the image area are conventionally formed with taper as shown in FIGS. 2A and 2B. The side surface of the image area is formed with a taper whether made by the molding method, the method utilizing the photosensitive resin, the method utilizing laser light.

Recently, a method for manufacturing a flexographic printing plate using an automatic drawing machine having an NC controlled cutting head has been practically used. The details of the automatic drawing machine are disclosed in the U.S. Patent Application Ser. No. 114,664 entitled "Apparatus for Automatically Providing Positioning Holes on Film Material" which is assigned to the owner of the present invention. In this case, two flat bodies of natural rubber, synthetic rubber or compound rubber (which is the mixture of the two) are used as the plate material. The two flat bodies are detachably bonded and the stacked flat bodies are cut by the above mentioned automatic drawing machine. The manufacturing method of the plate in this case is as follows.

First a plate material is placed on a cutting table of the automatic drawing machine. The cutting head is moved in the X and Y directions along the cutting table surface based on the NC data. Along with the above mentioned movement, the cutter blade mounted on the cutting head vertically cuts the upper layer flat body of the plate material from above to the interface between the upper and lower flat bodies. Thereafter, the unnecessary portion on one side of the cut line is removed manually or by simple instruments such as tweezers from the upper flat body.

The flexographic printing plate has been manufactured employing the above described methods. When the flexographic printing plate is manufactured by manually engraving the rubber plate material, the operator must be skilled and the operation efficiency is low. In addition, in this case, the cutting is carried out along the pattern, character and the like transferred onto the surface of the rubber plate material. The operator manually cuts the patterns or the like with visual observation. Therefore, the printing plate manufactured by this method is of questionable precision. This method cannot be used to manufacture printing plates with complicated image, areas. The method of manufacturing the printing plate by molding takes much time and it is a troublesome task to make a mold. The edge of the image area of the manufactured flexographic printing plate is not very acute. Therefore, when printing is carried out using the plate, high quality printing cannot be obtained. The printing plate manufactured by exposing the photosensitive resin with a predetermined mask is inferior to the rubber plate in durability for printing. In addition, the method is expensive and necessitates the use of large apparatus to manufacture the printing plate. In the method for manufacturing the flexographic printing plate utilizing laser light, the rubber plate material is directly processed based on the NC data. Therefore, it can save labor and reduce the time for manufacturing. However, in this case, the apparatus becomes large and complicated, increasing the cost of manufacturing the printing plate. FIG. 3 is a cross-sectional view of an image area of the flexographic printing plate manufactured by the automatic drawing machine. The flexographic printing plate manufactured by the automatic drawing machine comprises a convex rubber portion 1'' constituting the image area (which is the remaining portion of the upper layer of the stacked plate material with the unnecessary portions removed), the support rubber portion 3' constituted by the lower layer of the plate material and a textile layer 4' embedded in the support rubber portion 3'. However, in the flexographic printing plate manufactured in this manner, it is difficult to provide a tapered side surface to the convex rubber portion 1". Therefore, the strength of the printing plate becomes insufficient as the width of the convex rubber portion 1" constituting the image area becomes thinner. The printing plate cannot withstand the pressure at printing. Consequently, the convex rubber portion 1" is deformed in the transverse direction, preventing proper contact between the printing surface and the surface to be printed.

SUMMARY OF THE INVENTION

Therefore, an object of the present invention is to provide a flexographic printing plate which provides high printing quality even when the width of the image area is narrow.

Another object of the present invention is to provide a flexographic printing plate without tapered side surface provided to the image area which can withstand the printing pressure.

A further object of the present invention is to provide a flexographic printing plate whose manufacturing process can be implemented by numerical control.

A further object of the present invention is to provide a flexographic printing plate with the image area having acute edge and sufficient strength.

A further object of the present invention is to provide a flexographic printing plate which can be manufactured by a person not skilled in the art.

A further object of the present invention is to provide a flexographic printing plate which can be made in a shorter manufacturing time.

A further object of the present invention is to provide a flexographic printing plate which enables the labor saving of manufacturing.

A further object of the present invention is to provide a flexographic printing plate which is capable of precise printing.

A further object of the present invention is to provide a flexographic printing plate in which complicated image area can be easily formed.

The above described objects of the present invention can be accomplished by forming the flexographic printing plate by three or more layers of rubber material, with the layers being detachably bonded to each other and only the uppermost layer thereof being used as the printing surface.

Briefly stated, the flexographic printing plate in accordance with the present invention comprises a first rubber material which is to be the base of the printing plate, a second rubber material for supporting the surface of the printing plate detachably bonded on the region smaller than the first rubber material, and a third rubber material detachably bonded on the region smaller than the second rubber material or the second rubber material with the upper surface thereof constituting the surface of the printing plate.

Since the flexographic printing plate is formed as described above, the width of the image area can be gradually widen in the order of the third rubber material, the second rubber material and the first rubber material. Therefore, even if the image area (i.e. relief) of the printing surface is small, the second rubber material as well as the first rubber material stands against the pressure, whereby a flexographic printing plate can be obtained which provides high quality printing.

According to a preferred embodiment, the method for manufacturing the flexographic printing plate comprises the steps of preparing a plate material including a first rubber material which is to be the base of the printing plate, a second rubber material detachably bonded on the first rubber material with a prescribed strength and a third rubber material detachably bonded on the second rubber material with a prescribed strength; forming a first cutting line by cutting the third rubber material vertically from above along the prescribed line to a depth sufficient to reach the interface between the second rubber material and the third rubber material; removing the third rubber material existing in one region formed by the first cutting line; forming a second cutting line by cutting the second rubber material vertically from above in the above mentioned one region of the first cutting line to a depth sufficient to reach the interface between the first rubber material and the second rubber material; and removing the second rubber material existing in the above mentioned one region formed by the second cutting line.

Since the method for manufacturing the flexographic printing plate comprises the above described steps, the manufacturing process of the flexographic printing plate can be implemented by NC.

These objects and other objects, features, aspects and advantages of the present invention will become more apparent from the following detailed description of the present invention when taken in conjunction with the accompanying drawings.

DESCRIPTION OF THE PREFERRED EMBODIMENTS

A preferred embodiment of the present invention will be hereinafter described with reference to the figures.

Figure 1:
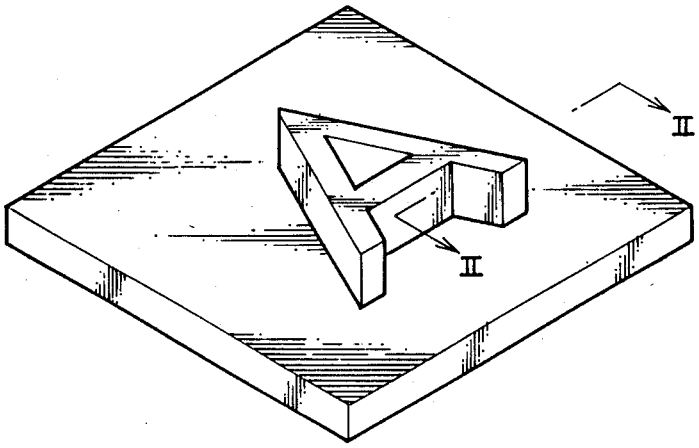
FIG.1 PRIOR ART
FIG. 1 is a perspective view of a conventional flexographic printing plate.
Figure 2A:
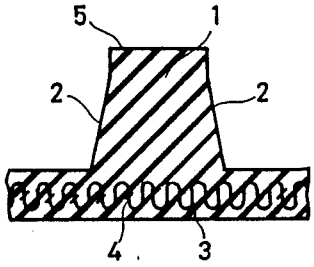
FIG.2A PRIOR ART
FIGS. 2A and 2B are cross-sectional views taken along the line II—II of FIG. 1.
Figure 2B:
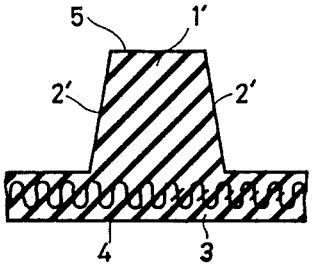
FIG.2B PRIOR ART
Figure 3:
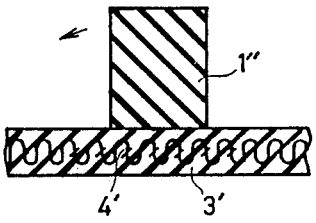
FIG.3 PRIOR ART
FIG. 3 is a cross-sectional view of an image area of the flexographic printing plate manufactured by the automatic drawing machine.
Figure 4:
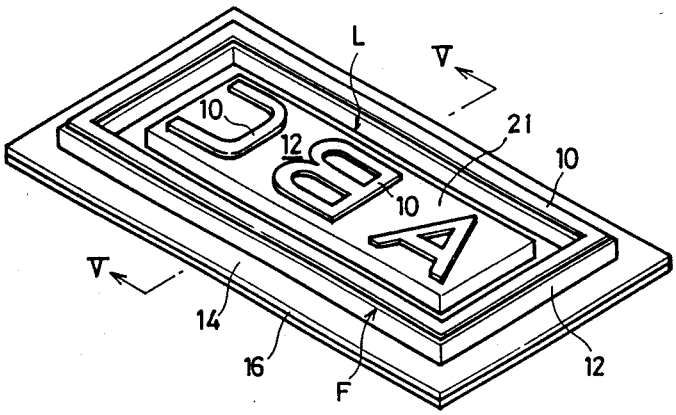
FIG. 4 is a perspective view of the flexographic printing plate in accordance with the present invention.
Figure 5:
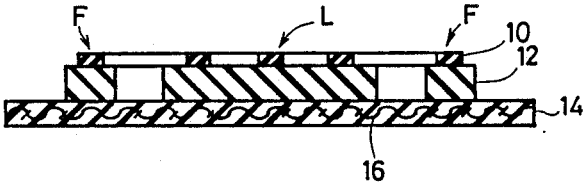
FIG. 5 is a cross-sectional view taken along the line V—V of FIG. 4.

FIG. 4 is a perspective view of the flexographic printing plate in accordance with one embodiment of the present invention, and FIG. 5 is a cross-sectional view of the portion shown by the line V—V of FIG. 4. The flexographic printing plate comprises a plate surface 10 on which the image area is formed, the plate surface supporter 12 which is bonded to the lower surface of the plate surface 10 to support the plate surface 10, and a support base 14 which is bonded to the lower surface of the plate surface supporter 12 for supporting the plate surface supporter 12. The support base 14 comprises a textile layer 16 such as duck. The textile layer 16 is provided to suppress stretching of the printing plate when the printing plate is mounted on a printing press.

Figure 6:
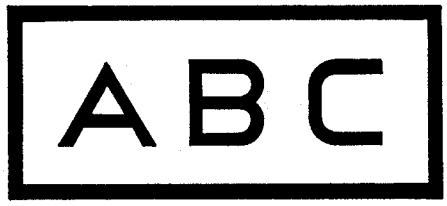
FIG. 6 is an example of a print provided by the flexographic printing plate shown in FIG. 4.

The plate surface 10, the plate surface supporter 12 and the support base 14 are all formed of rubber material such as natural rubber, synthetic rubber or compounded rubber which is the mixture of the natural rubber and the synthetic rubber. For example, the plate surface 10 is formed of the compounded rubber (the hardness of the rubber is of 40 degrees to 60 degrees in Shore scale A) constituted by the natural rubber (70 to 80 wt%) and acrylonitrile-butadiene rubber (20 to 30 wt%), and the thickness thereof is 1.0 to 1.5 mm. The plate surface supporter 12 is 2 to 6 mm in thickness. The plate surface supporter is formed of the compounded rubber (the hardness of the rubber is of 35 degrees to 50 degrees in Shore scale A) constituted by the polymer of the natural rubber (70 to 85 wt%) and styrene-butadiene rubber (15 to 30 wt%). The support base 14 is formed of two types of compounded rubber with the above mentioned duck or the like interposed therebetween. One of the compounded rubber layers (the rubber hardness is of 60 degrees in Shore scale A) is constituted by acrylonitrile-butadiene rubber (60 to 80 wt%) and chloroprene rubber (20 to 40 wt%). The other of the compounded rubber layers (the rubber hardness is of 50 degrees in Shore scale A) is constituted by the natural rubber (70 to 80 wt%) and styrene-butadiene rubber (20 to 30 wt%). In the embodiment shown in FIG. 4, the plate surface 10 comprises a frame portion F and a letter portion L. The frame portion F is supported by a frame like portion of the plate surface supporter 12 which is wider than the frame portion F. The letter portion L is supported by a rectangular portion of the plate surface supporter 12. The edge side surface of the image area of the plate surface 10 intersects substantially vertical to the upper surface of the plate surface supporter 12. The edge side surface of the plate surface supporter 12 intersects substantially vertically to the support base 14. The thickness of the whole flexographic printing plate is, for example, about 5 to 9 mm, in which the thickness of the plate surface 10 is about 1.0 to 1.5 mm as described above, the thickness of the plate surface supporter 12 is about 2 to 6 mm and the thickness of the support base 14 is 2.5 to 5.0 mm. The flexographic printing plate formed as described above is mounted on the peripheral surface of a press cylinder of the flexographic printing machine, as is well known. The flexographic ink is supplied to the plate surface by an inking roller. A material to be printed, for example a corrugated fiberboard, is introduced between the press cylinder and the impression cylinder. Consequently, printing is carried out on the surface of the corrugated fiberboard (none of the above mentioned process is shown). FIG. 6 shows printed matter provided by the flexographic printing plate shown in FIG. 4.

Figure 7A:
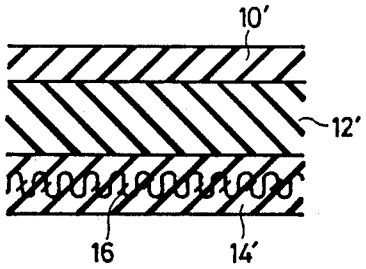
FIGS. 7A to 7C show the method for manufacturing the flexographic printing plate of the present invention step by step.
Figure 7B:
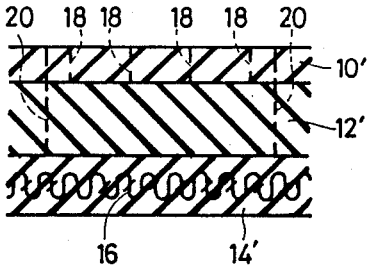
Figure 7C:
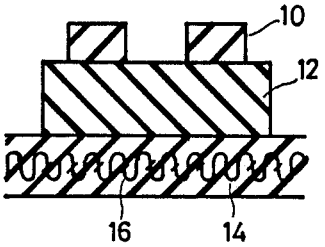

The manufacturing process of the flexographic printing plate will be hereinafter described with reference to FIGS. 7A to 7C. First, referring to FIG. 7A, an upper plate body 10' and an intermediate plate body 12' and a lower plate body 14' are stacked together. Each of the layers is detachably bonded to the adjacent layer. The upper plate body 10' is formed of, for example, a compounded rubber including natural rubber and acrylonitrile-butadiene rubber. The intermediate plate body 12' is formed of the compounded rubber including natural rubber and styrene-butadiene rubber. The lower flat body 14' is formed of the compounded rubber of acrylonitrile-butadiene rubber and the chloroprene rubber and of the compounded rubber including natural rubber and styrene-butadiene rubber, with a textile layer 16 is embedded between the above mentioned two kinds of compounded rubber. Thereafter, the upper plate body 10' is cut substantially vertically from above to a depth sufficient to reach the interface to the intermediate plate body 12' corresponding to the contour of the image area of the printing plate to be manufactured. Consequently, a cutting line 18 is formed in the upper plate body 10'. The upper plate body 10' and the intermediate plate body 12' are cut ,substantially vertically from above to a depth sufficient to reach the interface between the intermediate plate body 12' and the lower plate body 14' at a position outside the contour of the image area. Consequently, a cutting line 20 is formed in the upper plate body 10' and in the intermediate plate body 12'. The cutting of these cutting lines 18 and 20 are carried out, for example, in the following manner. The plate material is mounted on an automatic drawing machine comprising a cutting head having two cutter blades of different cutting depth or a cutting head having one cutter blade which can be controlled to change the cutting depth between two steps, that is, deep and shallow. The driving of the automatic drawing machine is controlled based on the NC (numerical control) data. More specifically, the above mentioned plate material is placed on the cutting table of the automatic drawing machine with the upper side turned up. The NC data is prepared based on the contour of the image area of the printing plate to be manufactured. Based on the prepared NC data, the cutting head is moved in the X and Y directions along the cutting table surface. The cutter blade is elevated and lowered with the movement. In this manner, deep and shallow cutting is carried out to form the cutting lines 18 and 20. The plate material is removed from the cutting table at the time when the cutting process is completed. The unnecessary portions of the upper plate body 10' and of the intermediate plate body 12' distinguished by the cutting lines 18 and 20 are then removed. This process is carried out manually or by a simple instrument such as tweezers by pinching and pulling transversely or upward a portion of the unnecessary portions of the plate bodies 10' and 12'. By this operation, the unnecessary portions of the upper plate body 10' and the intermediate plate body 12' are respectively removed from the surfaces of the intermediate plate body 12' and of the lower plate body 14'. Consequently, the flexographic printing plate comprising the plate surface 10, plate surface supporter 12 and the support base 14 is provided.

In this case, the bonding strength between the upper plate body 10' and the intermediate plate body 12' and that between the intermediate plate body 12' and the lower plate body 14' are a function of the solubility parameter of the polymer of the compounded rubber constituting each of the plate bodies. The bonding strength is preadjusted based on the printing pressure and on the facility of separation between each of the plate bodies when they are removed manually or by an instrument. Example of the bonding strength are shown in the following. When the upper plate body 10' is formed of the compounded rubber including 80 wt% of natural rubber and 20 wt% of styrene-butadiene rubber and the intermediate plate body 12' is formed of the compounded rubber including 25 wt% of chloroprene rubber and 75 wt% of acrylonitrile-butadiene rubber, then the bonding strength between the two is 1.0 kg/inch. When the ratio of the polymer in the compounded rubber of the intermediate plate body 12' is changed to 30 wt% of chloroprene rubber and 70 wt% of acrylonitrile-butadiene rubber, then the bonding strength becomes 1.5 kg/inch. When the ratio of the polymer of the compounded rubber for the intermediate plate body 12' is changed to 35 wt% of chloroprene rubber and 65 wt% of acrylonitrile-butadiene rubber, then the bonding strength becomes 2.0 kg/inch.

In the above described manufacturing process, the cutting of the deep and shallow, cutting lines may be carried out in any arbitrary order. One cutting line of (either deep or shallow) is cut first and thereafter the unnecessary portions corresponding to either one or the other portion of the line are removed. Thereafter, another cutting line is formed and the remaining unnecessary portions corresponding to either one or the other portion of the line are removed.

As described above, the cutting process, which is one step of manufacturing the flexographic printing plate, can be carried out based on the NC data. The removing process is also carried out by extremely simple operation. The plate surface 10 of the flexographic printing plate manufactured in the above described method has an image area with an acute edge. Even if the image area is small, the character portion L is supported by the rectangular portion of the plate surface supporter 12 and is reinforced. The frame portion F is supported and reinforced by the frame like portion of the plate surface supporter 12 which is larger than the frame portion F. Consequently, the flexographic printing plate according to the present invention is strong enough to withstand the printing pressure.

The weight proportion and the thickness of the compounded rubber constituting each of the plate bodies of the above mentioned flexographic printing plate is selected to optimally suit the particular application to which it will be put. For example, the flexographic printing plate of 9 mm thickness for printing corrugated fiberboard is formed of the following compounded rubber. Namely, the upper plate body (1.5 mm in thickness) is formed of the compounded rubber (the rubber hardness is of 40 degrees in Shore scale A) including 80 wt% natural rubber and 20 wt% acrylonitrile-butadiene rubber. The intermediate plate body (4.5 mm in thickness) is formed of the compounded rubber (the rubber hardness is of 35 degrees in Shore scale A) including 85 wt% natural rubber and 15 wt% styrene-butadiene rubber. The lower plate body (3 mm in thickness) is formed of a layer the compounded rubber including 75 wt% acrylonitrile-butadiene rubber and 25 wt% chloroprene rubber (0.5 mm thickness) and a layer (2.0 mm in thickness) of a compounded rubber including 80 wt% natural rubber and 20 wt% styrene-butadiene rubber and a duck (0.5 mm in thickness) interposed therebetween. The flexographic printing plate of 7 mm thickness for printing the corrugated fiberboard is made of the following compounded rubber. Namely, the upper plate body (1.0 mm in thickness) is formed of the compounded rubber (the rubber hardness is of 60 degrees in Shore scale A) including 70 wt% natural rubber and 30 wt% acrylonitrile-butadiene rubber. The intermediate plate body (3.5 mm in thickness) is formed of the compounded rubber (rubber hardness is of 50 degrees in Shore scale A) including 70 wt% natural rubber and 30 wt% styrene-butadiene rubber. The lower plate body (2.5 mm in thickness) is made of a layer (0.5 mm in thickness) of the compounded rubber including 60 wt% acrylonitrile-butadiene rubber and 40 wt% chloroprene rubber, a layer (1.5 mm in thickness) formed of the compounded rubber including 80 wt% natural rubber and 20 wt% styrene-butadiene rubber and a duck (0.5 mm in thickness) interposed therebetween.

Figure 8:
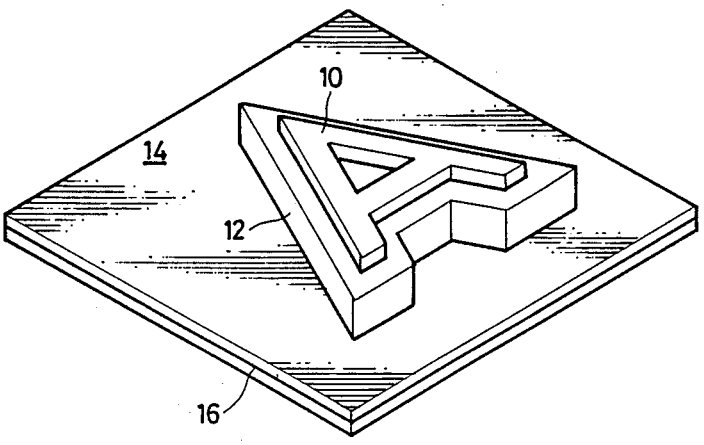
FIG. 8 shows another embodiment of the flexographic printing plate in accordance with the present invention.

FIG. 8 shows another embodiment of the flexographic printing plate in accordance with the present invention. In the flexographic printing plate shown in this embodiment, the edge portion of the plate surface supporter 12 is formed parallel to the edge of the letter portion of the plate surface 10 with a space of definite distance. Therefore, even if the interval between the image areas "A" and "B" or between "B" and "C" of the printing plate such as shown in FIG. 4 becomes wider, unnecessary ink is not supplied on the intermediate plate body between the image areas 21. Consequently, unnecessary ink will not be transferred onto the material to be printed.

Although the flexographic printing plate of the present invention is structured as described above, the scope of the invention is not limited to the contents of the above description and the drawings. For example, it goes without saying that the material, thickness and the like of the plate material is not limited to those described in the above embodiment. In the above embodiment, the plate surface and the plate surface supporter are respectively made of a single layer and the support body is made of plural layers. These components may be made with a single layer or with two or more layers as needed. The flexographic printing plate of the present invention provides the optimal effect when the manufacturing is carried out using NC apparatus. It may be used when the cutting of the plate material is carried out manually. Even in that case, much less skill in is required the in the conventional manual engraving. Consequently, labor can be saved and the time required for manufacturing can be reduced.

As described above, according to the present invention, the flexographic printing plate comprises a support base which is to be the base of the printing plate, a plate surface supporter for supporting the plate surface detachably bonded on the support base in the region smaller than the support base, and a plate body detachably mounted on the plate surface supporter in the region smaller than the plate surface supporter the surface of which constitute the printing surface.

Consequently, when the printing is carried out using the plate surface, the applied printing pressure is received not only by the plate body but also by the plate body supporter.

Therefore, even if the width of the image area which is to be the plate surface is small, a flexographic printing plate capable of high quality printing can be provided.

Although the present invention has been described and illustrated in detail, it is clearly understood that the same is by way of illustration and example only and is not to be taken by way of limitation, the scope of the present invention being limited only by the terms of the appended claims.

What is claimed is:

1. A flexographic printing plate, comprising:

a first layer formed of rubber material and reinforcing material, said first layer having a first upper support surface and a reinforcing layer which comprises said reinforcing material, said reinforcing layer being formed within said first layer, and not at said first upper support surface, and said first layer defining the base of the printing plate;

a second layer formed only of rubber material and located on only a portion of said first upper support surface of said first layer, said second layer having a second upper support surface; and a third layer formed only of rubber material and located on only a portion of said second upper support surface of said second layer, an upper surface of said third layer defining a plate surface of said printing plate;

whereby the printing pressure applied to said plate surface is received by said first and second layers when said plate is printed; and whereby said reinforcing layer within said first layer will not contact a cutting tool which is employed to cut said second and third layers.

2. A flexographic printing plate according to claim 1, wherein the width of said second layer is selected to have a strength sufficient to prevent deformation of said plate surface when said third layer is subjected to the printing pressure.

3. A flexographic printing plate according to claim 1, wherein a side wall of said third layer intersects vertically said upper surface of said second layer.

4. A flexographic printing plate according to claim 3, wherein the said plate surface vertically intersects said side wall of said third layer.

5. A flexographic printing plate according to claim 1, wherein said first layer comprises two layers of compounded rubber and a reinforcing layer interposed therebetween for reinforcing said compounded rubber layers.

6. A flexographic printing plate according to claim 5, wherein one of said layers of compounded rubber comprises acrylonitrile-butadiene rubber and chloroprene rubber and another of said layers comprises natural rubber and styrene-butadiene rubber.

7. A flexographic printing plate according to claim 5, wherein said reinforcing layer comprises a duck layer.

8. A flexographic printing plate according to claim 1, wherein said second layer comprises a compounded rubber layer including natural rubber and styrene-butadiene rubber.

9. A flexographic printing plate according to claim 1, wherein said third layer comprises a compounded rubber layer including natural rubber and acrylonitrile-butadiene rubber.

10. A flexographic printing plate according to claim 9, wherein the thickness of said third layer is between 1.0 and 1.5 mm.

11. A flexographic printing plate according to claim 10, wherein the thickness of said second layer is between 2 and 6 mm.

12. A flexographic printing plate according to claim 1, wherein said first layer underlies all of said second layer and is larger than said second layer and said third layer underlies all of said second layer and is larger than said second layer.

13. A method for manufacturing a flexographic printing plate, said method comprising the steps of:

providing a plate material including a first layer formed of rubber material which is to be the base of said printing plate, said first layer having a reinforcing layer comprising a reinforcing material formed therein, a second layer formed only of rubber material and detachably bonded to said first layer with a prescribed strength, and a third layer formed only of rubber material and detachably bonded on said second layer with a prescribed strength;

forming a first cutting line by cutting said third layer along a prescribed line to the interface between said second layer and said third layer;

removing a portion of said third layer existing in one region formed by said first cutting line;

forming a second cutting line by cutting said second layer in the area of said one region to the interface between said first layer and said second layer; and removing a portion of said second layer existing in a region formed by said second cutting line whereby the plate surface formed of said third layer is supported by said second layer;

said reinforcing layer being formed within said first layer, and not at said interface between the first and second layers, whereby said reinforcing layer is not contacted by any cutting tool which is employed to form said second cutting line.

14. A method for manufacturing a flexographic printing plate according to claim 13, wherein the width of said second layer has a strength which is sufficient to prevent the deformation of said plate surface when said third layer is subjected to a printing pressure.

15. A method for manufacturing a flexographic printing plate according to claim 13, wherein a side wall of said third layer vertically intersects a horizontal surface of said second layer.

16. A method for manufacturing a flexographic printing plate according to claim 13, wherein said plate surface vertically intersects said side wall of said third layer.

17. A method for manufacturing a flexographic printing plate according to claim 13, wherein said first layer comprises two layers of compounded rubber and a reinforcing layer interposed therebetween for reinforcing said compounded rubber layers.

18. A method for manufacturing a flexographic printing plate according to claim 17, wherein one of said layers acrylonitrile-butadiene rubber and chloroprene rubber and a second of said layers comprises natural rubber and styrene-butadiene rubber.

19. A method for manufacturing a flexographic printing plate according to claim 17, wherein said reinforcing layer comprises a duck layer.

20. A method for manufacturing a flexographic printing plate according to claim, 13, wherein said second layer comprises a compounded rubber layer including natural rubber and a styrene-butadiene rubber.

21. A method for manufacturing a flexographic printing plate according to claim 13, wherein said third layer comprises a compounded rubber layer including natural rubber and acrylonitrile-butadiene rubber.

22. A method for manufacturing a flexographic printing plate according to claim 13, wherein the thickness of said third layer is between 1.0 and 1.5 mm.

23. A method for manufacturing a flexographic printing plate according to claim 13, wherein the thickness of said second layer is between 2 and 6 mm.

24. A method for manufacturing a flexographic printing plate according to claim 13, wherein said steps of forming said first cutting line (18) and said second cutting line are carried out by an NC apparatus.

25. A method for manufacturing a flexographic printing plate according to claim 13, wherein said first layer underlies all of said second layer and is larger than said second layer and said third layer underlies all of said second layer and is larger than said second layer after said second removing step is completed.

26. A method for manufacturing a flexographic printing plate according to claim 13, wherein said first, second and third layers each has an upper planar surface, each of said surfaces being parallel to each other and wherein said first and second cutting lines are formed along planes which are perpendicular to said upper surfaces of said first, second and third layers.

27. A flexographic printing plate formed by the steps of:

preparing a multi-layered plate including a first layer formed of rubber material and having an upper support surface, said first layer having a reinforcing layer comprising a reinforcing material formed therein, a second layer formed only of rubber material detachably coupled to said upper support surface of said first layer, said second layer having an upper support surface, and a third layer formed only of rubber material detachably bonded to said upper surface of said second layer, said third layer having an upper surface;

forming a first cutting line by cutting said third layer to the interface between said second and third layers and removing a portion of said third layer existing in a region defined by said first cutting line, thereby leaving only a portion of said third layer on said second layer; and forming a second cutting line by cutting said second layer to the interface between said first and second layers and removing a portion of said second layer from said first layer so that only a portion of said second layer remains on said first layer, said remaining portion of said second layer underlying and being larger than said remaining portion of said third layer, whereby said upper surface of said third layer defines a plate surface and a printing pressure applied to said plate surface is received by said remaining portion of said second layer and said first layer;

said reinforcing layer being formed within said first layer, and not at said interface between the first and second layers, whereby said reinforcing layer is not contacted by any cutting tool which is employed to form said second cutting line.

28. A flexographic printing plate according to claim 27, wherein the width of said second layer is selected to have a strength sufficient to prevent deformation of said plate surface when said third layer is subjected to a printing pressure.

29. A flexographic printing plate according to claim 27, wherein said first layer comprises two layers of compounded rubber and a reinforcing layer interposed therebetween for reinforcing said compounded rubber layers.

30. A flexographic printing plate according to claim 29, wherein one of said layers of compounded rubber comprises acrylonitrile-butadiene rubber and chloroprene rubber and another of said compounded rubber layers comprises natural rubber and styrene-butadiene rubber.

31. A flexographic printing plate according to claim 29, wherein said reinforcing layer comprises a duck layer.

32. A flexographic printing plate according to claim 27, wherein said second layer (12) comprises a compounded rubber layer including natural rubber and styrene-butadiene rubber.

33. A flexographic printing plate according to claim 27, wherein said third layer comprises a compounded rubber layer including natural rubber and acrylonitrile-butadiene rubber.

34. A flexographic printing plate according to claim 33, wherein the thickness of said third layer is between 1.0 and 1.5 mm.

35. A flexographic printing plate according to claim 34, wherein the thickness of said second layer is between 2 and 6 mm.

36. A flexographic printing plate according to claim 27, wherein said first and second cutting lines are formed along planes extending perpendicular to said plate surface of said third layer.

* * * * *